US006325301B1

(12) United States Patent
Vanhonacker

(10) Patent No.: US 6,325,301 B1
(45) Date of Patent: Dec. 4, 2001

(54) TRACK SUPPORT SYSTEM

(76) Inventor: Patrick Vanhonacker, Konijnenpijp 5, 3210 Linden (BE)

( * ) Notice: Subject to any disclaimer, the term of this patent is extended or adjusted under 35 U.S.C. 154(b) by 0 days.

(21) Appl. No.: 09/652,239

(22) Filed: Aug. 31, 2000

Related U.S. Application Data

(63) Continuation-in-part of application No. PCT/BE99/00120, filed on Sep. 17, 1999.

(30) Foreign Application Priority Data

Feb. 5, 1999 (BE) ..... 09900083

(51) Int. Cl.[7] ..... E01B 19/00

(52) U.S. Cl. ..... 238/382; 238/283; 238/338; 238/342; 238/345; 238/349

(58) Field of Search ..... 238/2, 3, 8, 264, 238/266, 269, 281, 282, 283, 310, 315, 338, 342, 345, 349, 382

(56) References Cited

U.S. PATENT DOCUMENTS 2,421,502 6/1947 Hayes .
4,765,538 * 8/1988 Meyer ..... 238/283
4,844,338 * 7/1989 Bucksbee ..... 238/283
5,314,115 * 5/1994 Moucessian ..... 238/30
6,027,033 * 2/2000 Vanhonacker ..... 238/382
6,027,034 * 2/2000 Demmig et al. ..... 238/382

FOREIGN PATENT DOCUMENTS 2 737 511 2/1997 (FR) .
296 19 480 2/1997 (DE) .
WO 97/42376 11/1997 (WO) .

* cited by examiner

*Primary Examiner*—Mark T. Le
(74) *Attorney, Agent, or Firm*—Barry R. Lipsitz

(57) ABSTRACT

In a device for supporting a rail fastened to a sole-plate resting on an anti-vibration pad, the sole-plate is urged towards the supporting structure by at least one adjustable prestressing resilient device acting on the sole-plate so as to apply a defined prestressing force to the anti-vibration pad. Each prestressing resilient device includes a threaded bolt, an adjusting nut and a vertically acting spring assembly which comprises a first spring having a first stiffness, a second spring arranged round the first spring and having a second stiffness higher than said first stiffness, and a device for retaining said first and second springs in such a way that each of said springs is able to act independently from the other one.

8 Claims, 14 Drawing Sheets

TRACK SUPPORT SYSTEM

CROSS-REFERENCE TO RELATED APPLICATIONS

This application is a continuation-in part of international application PCT/BE99/00120, filed on Sep. 17,1999.

BACKGROUND OF THE INVENTION

The present invention falls within the field of devices for mounting the rails of a railway track. It relates more particularly to a track support system to be affixed directly onto a bed or floor or onto sleepers.

Current devices for fixing track rails include fastener means and at least one pad made of elastic material which gives elasticity to the wheel-rail assembly so that there is obtained a degree of is of the environment with respect to the vibrations produced by the dynamic forces applied to the rails when a vehicle runs on the rails.

There is almost always an elastic device in the form of a relatively rigid pad directly beneath the rail. There is often a second, more flexible pad beneath a metal sole-plate or a sleeper. The latter pad provides anti-vibration isolation.

The first resonant frequency, in flexure, of the wheel-rail assembly depends on the dynamic stiffness of the pads. This resonant frequency is inversely proportional to the anti-vibration performance of the rail-fixing system: a low resonant frequency gives better anti-vibration isolation than a high resonant frequency. With pads which have a low dynamic stiffness, the first resonant frequency of the wheel-rail assembly is reduced, thereby giving rise to a good anti-vibration filter. The best filter is therefore obtained with the lowest dynamic stiffness of the pads.

However, there is a lower physical limit to this dynamic stiffness of the pads used in the current rail-fixing systems. The dynamic stiffness is directly proportional to the static stiffness of the pads. The static stiffness of the pads cannot be too low because of the fact that it has a direct influence on the deflection of the rails when a vehicle is running along the rails. This rail deflection is generally limited to approximately 3 mm. This static rail deflection limit imposes a minimum static stiffness, and thus a minimum dynamic stiffness of the anti-vibration pad. This phenomenon limits the anti-vibration isolation performance of the current rail-fixing systems. For most current fixing devices, the resonant frequency lies between 35 Hz and 60 Hz.

In order to obtain a superior isolation performance to that obtained with the current fixing systems, it is necessary for the fixing and isolation functions to be completely decoupled. This is realized in systems of the floating-slab type in which the rails are fixed onto a slab which is itself isolated from the environment by anti-vibration studs placed between the slab and the bed (or floor). In the case of a floating slab, the resonant frequency lies between approximately 10 Hz and 25 Hz, which gives a better anti-vibration filter. The latter systems are however very expensive and difficult to maintain.

BRIEF SUMMARY OF THE INVENTION

It is the primary object of the present invention to provide a rail support system for being fixed directly onto a bed or floor or onto sleepers anchored into a concrete bed or in the ballast, which has an anti-vibration isolation performance close to that obtained with a floating slab and which at the same time ensures good rail stability.

This object is achieved according to the invention by a rail support system which comprises a sole plate resting on an anti-vibration pad disposed on a supporting structure and at least one adjustable prestressing resilient device acting on the sole-plate to urge the sole-plate towards the supporting structure and apply a defined prestressing force to the anti-vibration pad so that the static deflection of the rail is limited to a defined value when a vehicle moves over the rail.

As a result of the prestress applied to it, the anti-vibration pad always works in the region of quasi-linear behaviour of its deflection curve. When a wheel passes on the rail in the region of the support device, the anti-vibration pad continues to operate in the region of quasi-linear behaviour. The prestress becomes very low when the wheel passes over the support device and the static deflection of the rail is limited while the desired anti-vibration isolation is provided. The system of the invention thus provides, for supporting the rail, a high apparent static stiffness together with a low dynamic stiffness. It is also useful in affixing two rails in a curve, whereby the invention provides a reduction in squeaking noise.

The rail support system according to the invention may be realized with or without a metal base-plate underneath the anti-vibration pad. In the first case, the sole-plate which carries the rail is fastened to the base-plate by means of the prestressing devices. In the second case, the sole-plate is anchored directly into the track bed by means of the prestressing devices.

A further object of this invention is to provide a sole-plate for supporting a rail, which is specially adapted for being anchored directly into the support structure of the track with an anti-vibration pad underneath sole-plate.

DETAILED DESCRIPTION OF THE INVENTION

Figure 1:
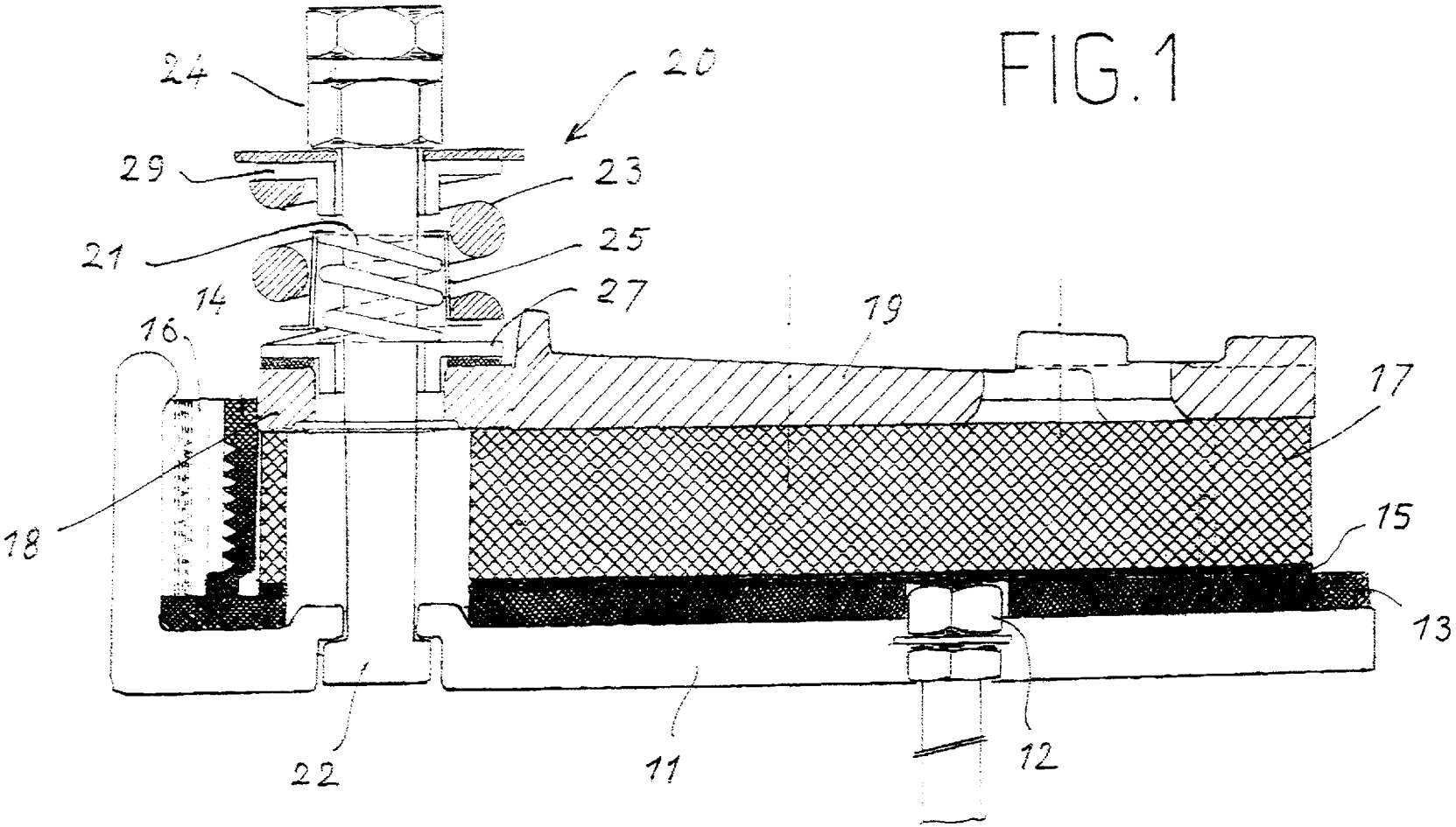
FIG. 1 shows a cross-sectional view of a first embodiment of the rail support system according to the invention.

The rail support device represented in FIG. 1 essentially comprises a base-plate 11 to be anchored into a concrete slab or a sleeper (not represented), an anti-vibration pad 17 and a sole-plate 19 onto which a rail can be fastened. The base-plate 11 has upstanding projections and forms thereby a recessed body. It is fixed to the support structure through bolts 12. An insert 13 is provided, in case of need, with a thickness chosen so as to allow leveling of the heads of the fastening bolts 12 and the bulges in the surface of the base plate 11. The insert 15 serves as a cover for the holes in the insert 13. The anti-vibration pad 17 has dimensions chosen in accordance of the natural frequency of the track.

The sole-plate 19 rests onto the anti-vibration pad 17. It is comprised of a metal body, having a generally rectangular shape. The middle portion of the body is intended for supporting the flange of a rail and it has holes therethrough for fastening the rail onto the sole-plate. On both sides of the middle portion, the sole-plate 19 presents at least two rim portions 18 and each of them has a hole therethrough for receiving a fastening means for fixing the sole-plate 19 to the base-plate 11. The whole assembly is retained within the recess in the base-plate 11 with interposition of a lateral stop element 14 and an adjustment element 16 which are provided on either side thereof. The sole-plate 19 is fastened to the base-plate 11 by means of bolts, for example T-head bolts such as bolt 22, and by means of prestressing resilient devices 20 having the function of subjecting the anti-vibration pad 17 to a defined prestress.

Each prestressing device 20 comprises an integrate assembly of two springs 21 and 23 arranged on the bolt 22 so as to be able to act vertically. Spring 21 is arranged inside spring 23 and is chosen with a lower stiffness than that of spring 23. The spring 21 has for instance a stiffness of 1800 N/cm whereas the spring 23 has, for instance, a stiffness of 50 to 150 kN/cm. The spring 21 is shorter than the spring 23 and its lower end rests on a supporting washer 27. Its upper end supports a sleeve 25 serving to facilitate application of the prestress force and the return movement of the higher stiffness spring. The sleeve 25 is arranged to support the lower end of spring 23. The upper end of spring 23 cooperates with an adjusting washer 29 which in turn cooperates with an adjusting nut 24 on the threaded end of bolt 22. The abutment washer 29 has a flange 28 on its lower surface to cooperate with the sleeve 25 for applying the prestress force to the spring 21. The prestress force is adjusted by screwing the nut 24. With this arrangement, the two springs act independently form one another. When a wheel passes over the support system, the spring 23 is completely free from any prestress and it has no effect on the dynamic stiffness of the wheel-rail-support assembly. Only the spring 21 applies a low prestessing force when a wheel passes on the rail.

Figure 2:
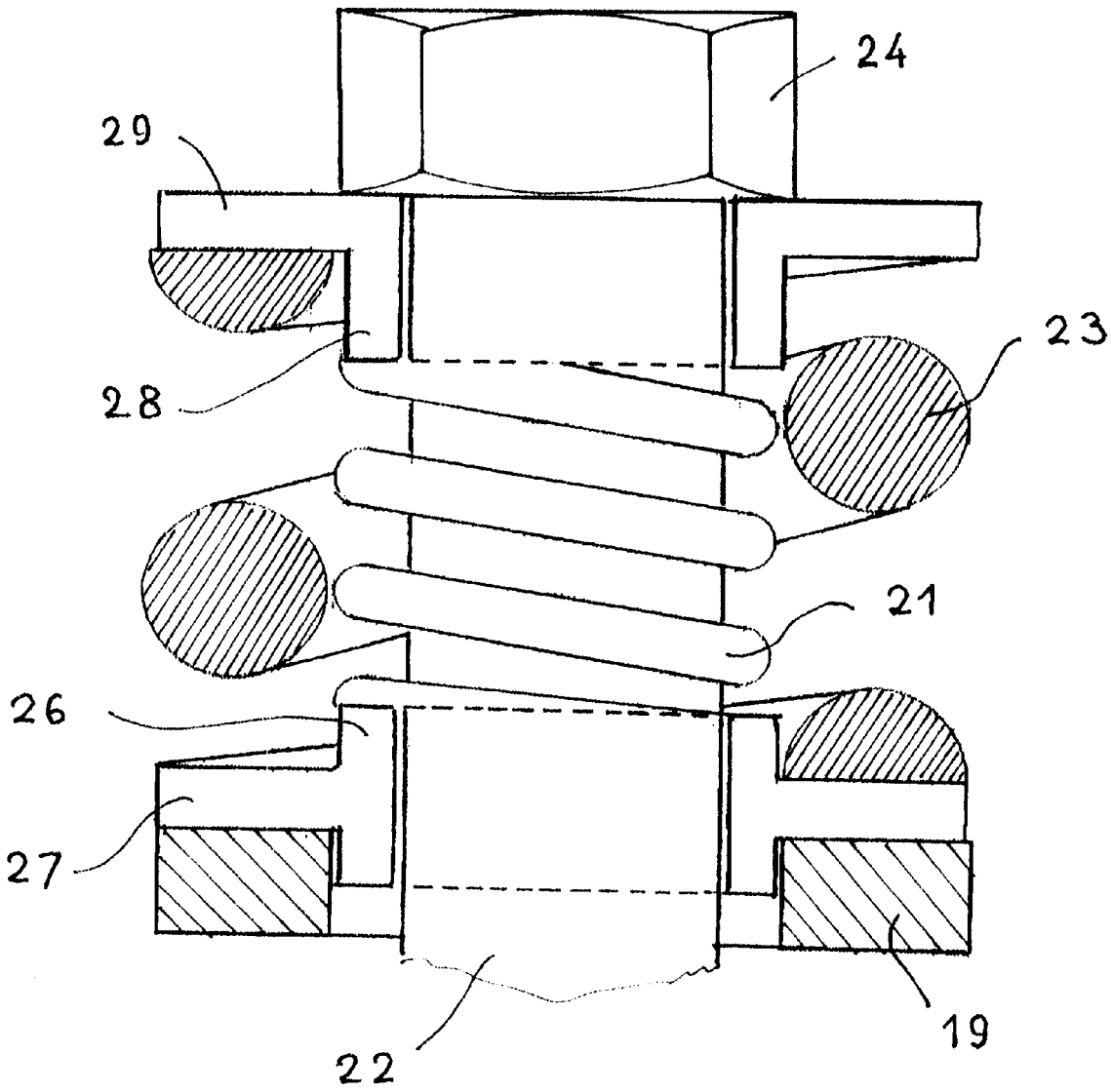
FIG. 2 is an enlarged representation of a variant of the prestressing resilient device used in the rail support system according to the invention.

FIG. 2 shows a variant of the prestressing device provided in accordance with the invention. In this embodiment, the supporting washer 27 supports the lower end of both springs 21 and 23. The upper surface of washer 27 has an upstanding flange 26 which cooperates with the lower end of spring 21. This arrangement provides more space to the spring 23.

Figure 3:
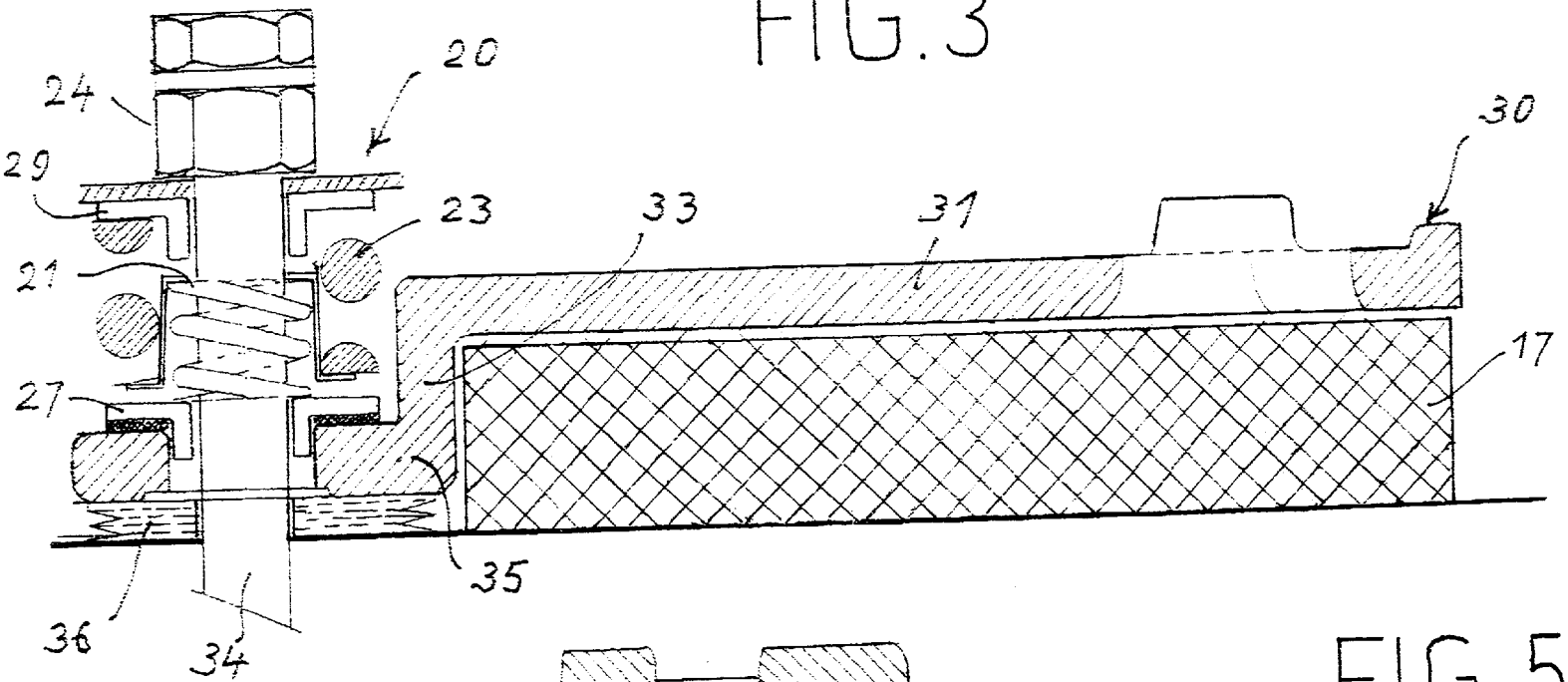
FIG. 3 shows a cross-sectional view of a second embodiment of the invention, taken along line III—III in FIG. 4.
Figure 5:
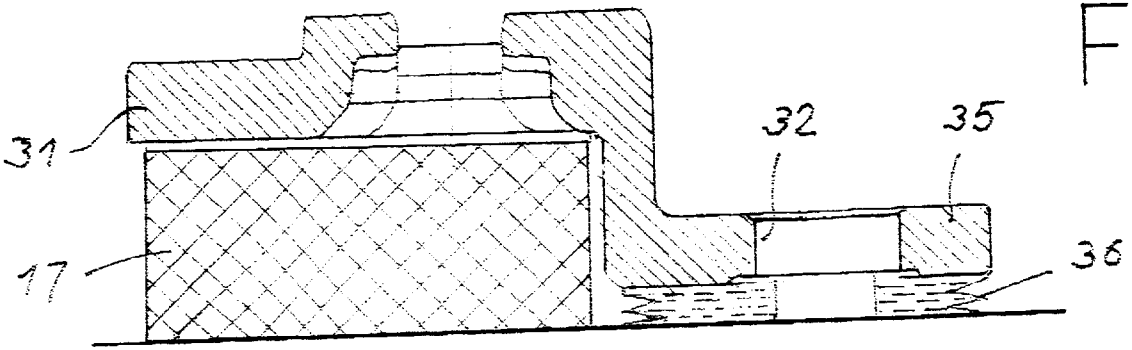
FIG. 5 is a cross-sectional view along line V—V in FIG. 4.
Figure 4:
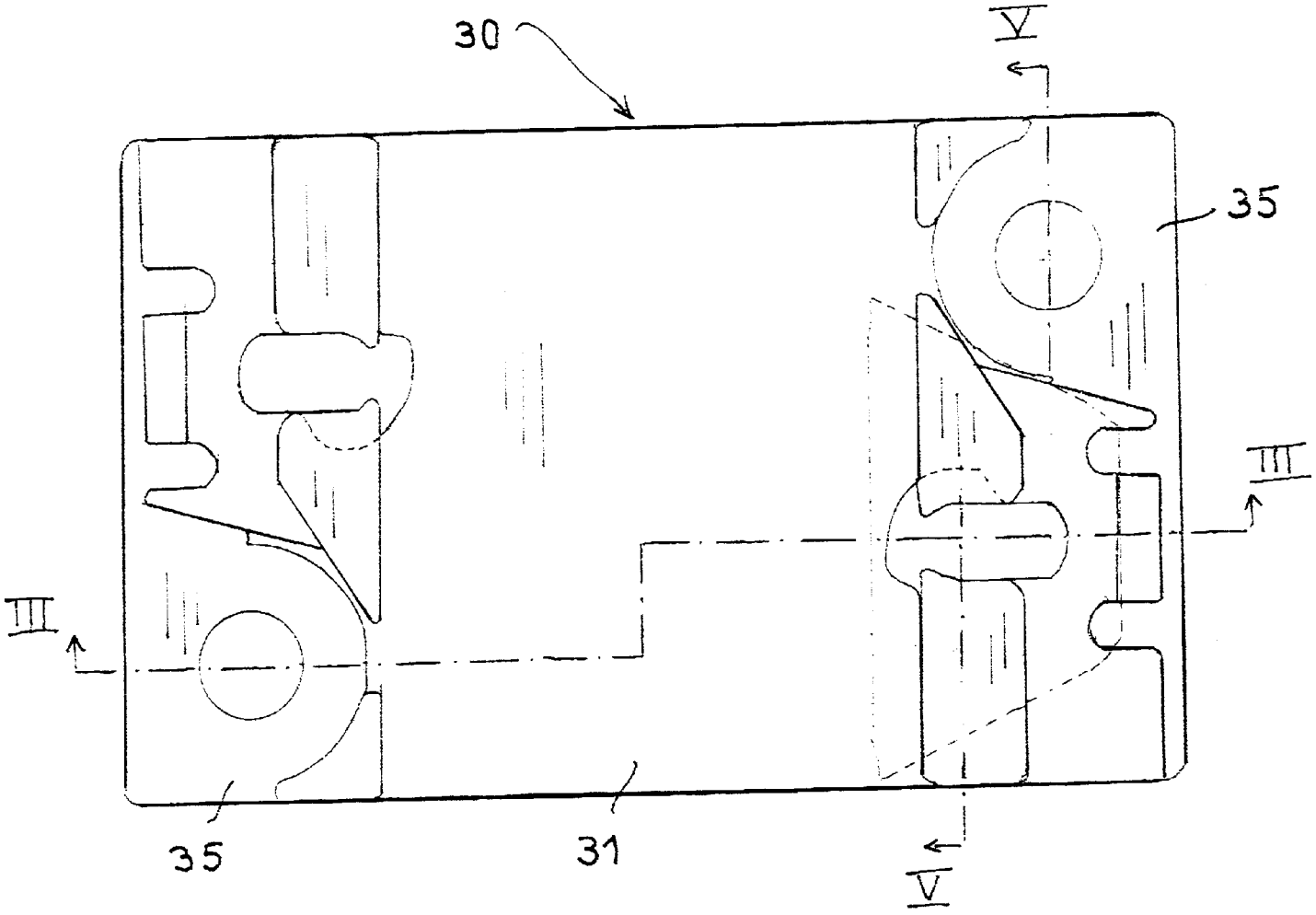
FIG. 4 is a top view of the sole-plate used in the device of FIG. 3.

FIG. 3 represents an embodiment of the invention, in which the sole-plate is fastened directly to the bed of the track or to a slab, a sleeper or any support structure through prestressing resilient devices as described above herein. In this embodiment, there is provided a sole-plate as illustrated in FIGS. 3 through 5. This particular sole-plate 30 presents a platform 31 for covering the top of the anti-vibration pad 17, and which connects with side projections 33 that extend perpendicularly to the platform so 35 as to cover the sides of the anti-vibration pad 17. The side projections 23 in turn connect with at least two rim portions 35 situated below the level of the platform 31. The rim portions 35 are pierced with holes 32 for receiving threaded rods 34 therethrough for fastening the sole-plate to the support structure. The rods 34 receive the prestressing springs 21 and 23 thereabout. The rim portions 35 situated at a lower level than the remaining of the body permit the use of threaded rods 34 having a reduced height. Thus, the prestressing device 20 is less bulky with respect to the rolling surface. In addition, the rim portions 35 allow the rail support device to be more perfectly adapted to the surface of the bed when a coating is to be provided. Finally, the rim portions 35 make it possible to place stop elements 36 beneath their lower face. This results in the counter-coupling to be increased in case of overload and thus results in the horizontal displacement of the rail to be limited in this event. Another advantage of providing stop elements 34 is preventing accumulation beneath the sleeper, which dirt accumulation can possibly provoke blockage.

Figure 6:
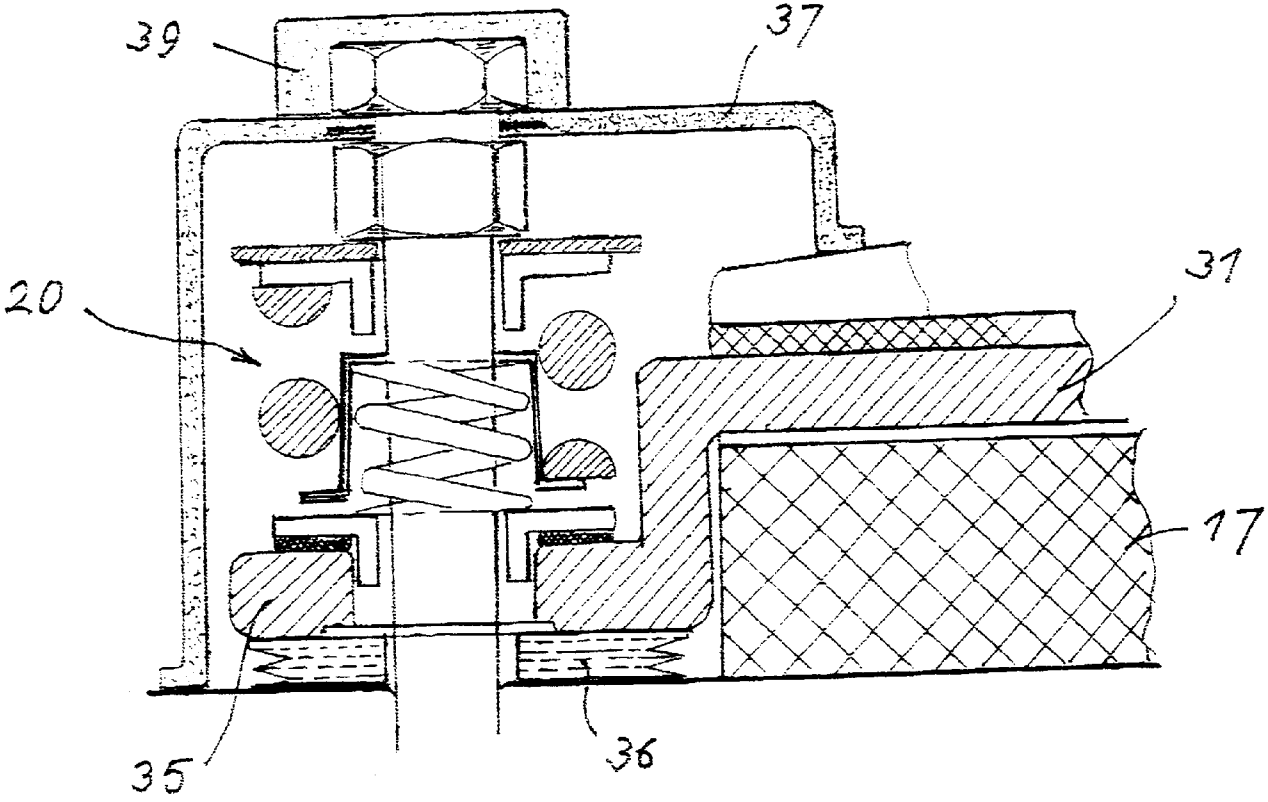
FIG. 6 shows a variant of the arrangement represented in FIG. 3.

As shown in FIG. 6, the prestressing device according to the invention can be protected by a protection cap 37 and an additional cap 39 can be provided for the blocking screw used for securing the protection cap 37.

The rail support system described in the foregoing thus uses resilient prestressing devices, each of which includes two spring elastic stages acting independently from one another. It should be noted that rail-fixing systems having two elastic stages with springs already exist. However, these known systems have the sole purpose of keeping the sole-plate or the sleeper mechanically in place and of allowing deflection of the sole-plate. Moreover, the prestress applied to the springs in the known systems is very low (a few thousands of Newtons, only). On the other hand, the anti-vibration pad in the device according to the invention is subjected to a significant prestress (ranging about 10 kN).

Figure 7:
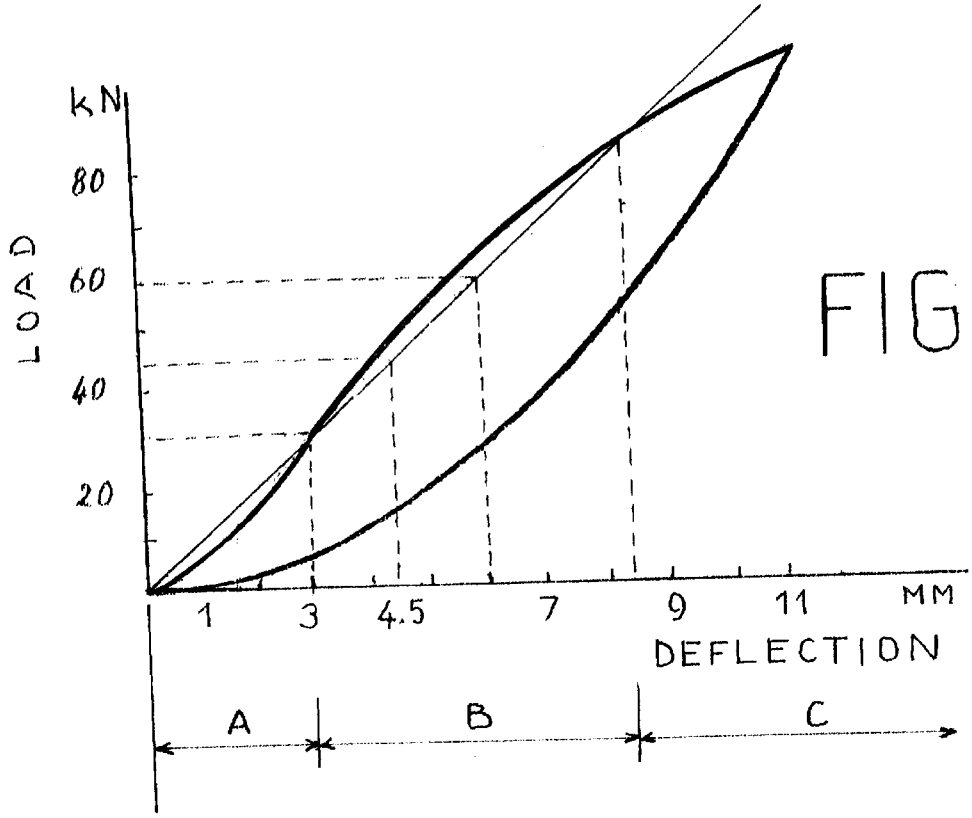
FIG. 7 is a diagram representing a typical static deflection curve of an anti-vibration pad.

The anti-vibration pads have a static deflection curve as shown in FIG. 7. Three regions may be distinguished in this curve:

(a) a non-linear loading region (A);

(b) a quasi-linear region (B) in which the product has to operate;

(c) a nonlinear (C) which cannot be used.

In operation, the actual load applied to a rail support when a vehicle wheel passes over it, is quasi-static and rapid. In order to prevent the operating point from passing every time into the non-linear loading region of its deflection curve, it is important for the anti-vibration pad always to work in the linear region. Therefore, when fixing a rail, the prestressing device of the invention is adjusted in such a manner that the anti-vibration pad is subjected to a significant prestress so that the pad always works in the region of linear behaviour (B).

In accordance with an aspect of the invention, based on the technical data with regard to the track bed and to the rolling stock, the rail support device is defined by taking into account in the first place, the desired anti-vibration isolation performance (wheel-rail resonant frequency). In general, this performance necessitates a low dynamic stiffness. The desired static stiffness, which depends on the material the pad is made of, is derived from the dynamic stiffness. The static stiffness generally results in significant static displacements of the rail, which are not tolerated. The prestressing devices are then adjusted in such a manner that the anti-vibration pad is given a prestress which is such that the difference between the rail displacement before the prestress force is applied and the rail displacement after the prestress force is applied remains less than the tolerated rail displacement (in general 3 mm). Preferably, the pad is chosen so that it works in the quasi-linear region of its deflection curve with the additional load which is added on top of it when a wheel passes over it.

In the case of a system for fixing a rail of the UIC 60 type on concrete, with a sleeper spacing of 60 cm, an unsprung vehicle mass of 1000 kg, an axle load of 180 kN and a resonant frequency of the wheel-rail assembly of 22 Hz (an isolation similar to the floating slab situation), a dynamic stiffness of the anti-vibration pad in the fixing system of approximately 10 kN/mm (calculation using the finite-element method) is necessary. By using for the anti-vibration pad, a product having a static stiffness equal to the dynamic stiffness, a rail deflection of 4.5 mm (FIG. 7) is obtained with the axle load in question (180 kN). For example, it is possible to use a quasi-isotropic microcellular product, such as polyurethane with a hybrid structure.

If the prestressing devices 20 are adjusted so that the anti-vibration pad is given a prestress of about 30 kN, with two springs 23 of 15 kN/mm both compressed by 1 mm, the rail deflection is about 1.5 mm, which is quite acceptable. When a wheel passes over a support device, the springs 23 do not apply any prestress. Only the return springs 21 apply a low prestress force and the system remains dynamically very flexible.

Figure 8:
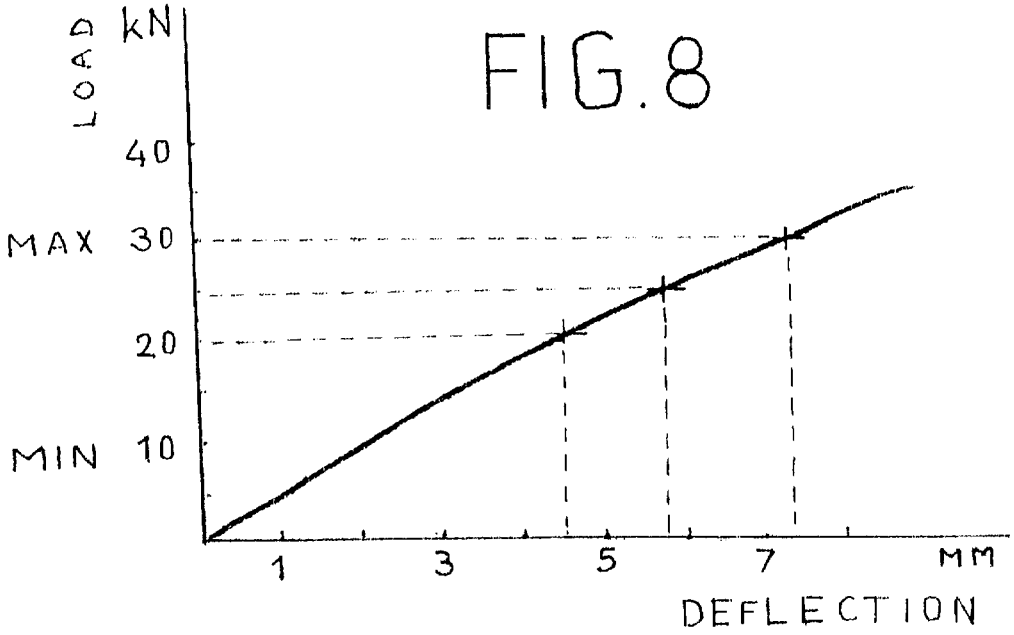
FIG. 8 shows a typical loading curve of an anti-vibration pad with a support system according to the invention.

FIG. 8 shows a typical loading curve for an anti-vibration pad which is suitable for an axle load of about 100 to 120 kN, for example. Taking account of the static load per axle on anti-vibration support, a minimum load of 20 kN on the anti-vibration pad, for example, is obtained. The prestress to be applied by the device 20 is then chosen equal to this minimum load. When a made up train runs on the rails, the load can vary between 20 and 30 kN The prestress chosen (e.g. 20 kN) defines the minimum operating point of the system, which results in a rail deflection of ±4.5 mm. This prestress is achieved, for instance, using two springs 23 of 10 kN/mm which are both compressed by 1 mm.

In the event a train applies an axle load of 100 kN, be average impact on each support is about 25 kN and this results in an additional rail deflection of ±1.3 mm. For an axle load of 120 kN, the average impact on the support is about 30 kN, which results in an additional deflection of ±3.1 mm. The system according to the invention thus behaves dynamicaly so as to produce a deflection of 4.5 mm for an applied load of 20 kN 5.8 mm for an applied load of 25 kN 7.4 mm for an applied load of 30 kN.

It should be noted that the two springs 23 release completely when a wheel is passing over the support. The invention permits optimum operating conditions to be realized on anti-vibration supports, that is a very low dynamic stiffness and at the same time a rail deflection limited to the tolerated value, for example ±3 mm (instead of ±8 mm).

Figure 9:
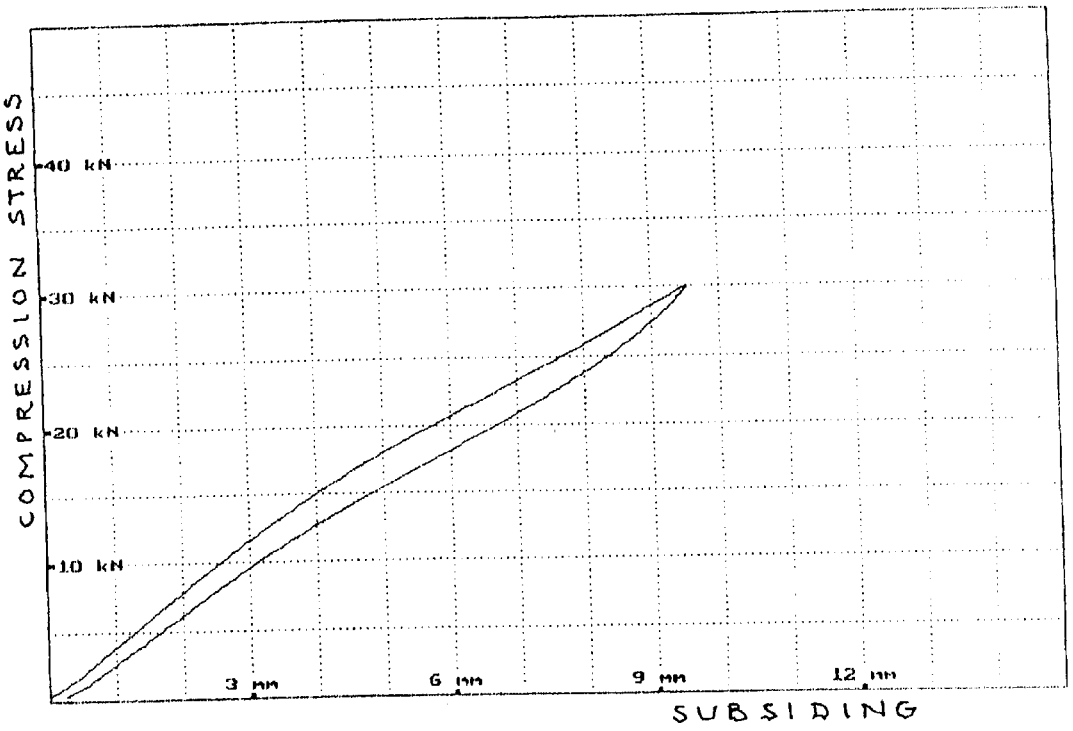
FIG. 9 illustrates the static stiffness curve of an exemplary rail support.

Tests have been made on a rail sample 6 m long with a 52000 $mm^2$ cross-section and seven fixing points equipped with prestressing devices according to this invention for the purpose of verifying the static and dynamic behaviour of the assembly. The supports used were of the SYL.S65XS/300.180.50 type. FIG. 9 shows the compression stress vs subsiding of the sample for increasing applied loads applied at a rate of 30.0 kN/min up to a maximum load of 29.952 kN. Each load level was applied during 0.5 minute. The diagram shows that the deflection under a load of 25 kN was about 8 mm. The static stiffness measurements were as follows:

| Tangent modul | |
|---|---|
| at 3.0 kN: | 3858 N/mm |
| at 6.0 kN: | 3930 N/mm |
| at 9.0 kN: | 3768 N/mm |
| at 12.0 kN: | 3532 N/mm |
| at 15.0 kN: | 3197 N/mm |
| at 18.0 kN: | 2841 N/mm |
| at 21.0 kN: | 2621 N/mm |
| at 24.0 kN: | 2585 N/mm |
| at 27.0 kN: | 2679 N/mm |
| Hysteresis loop area (N.mm): | 18244 |

These measurements show that the static stiffness of the sample was on an average 3600 N/mm for a load lower than 15.0 kN.

Figure 10:
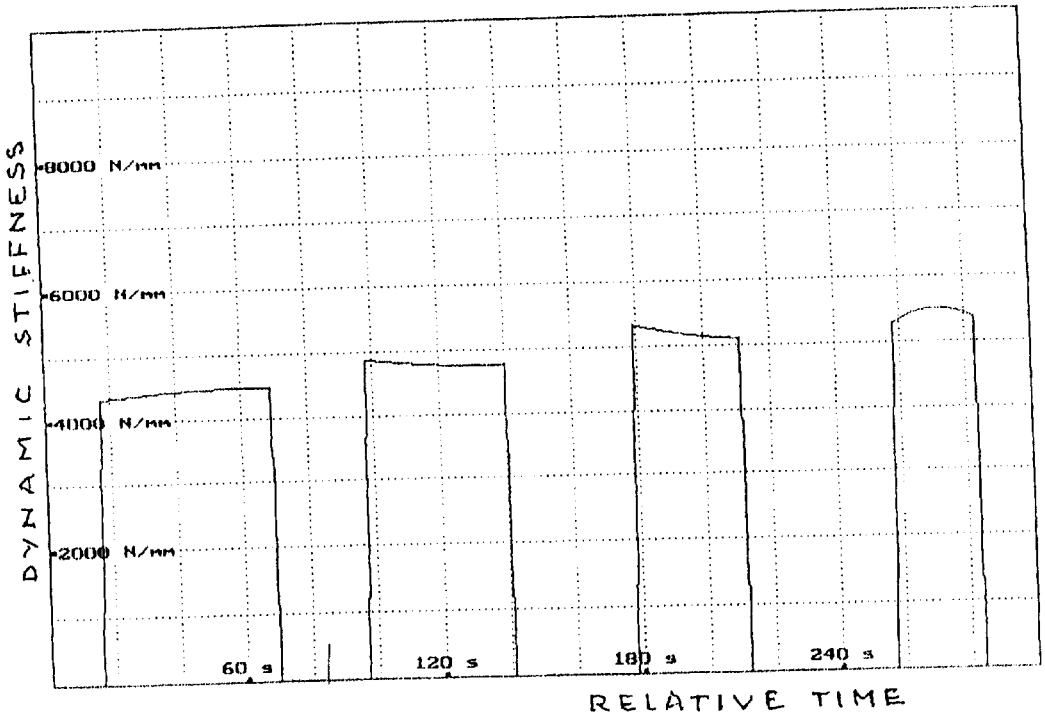
FIG. 10 illustrates the dynamic stiffness curve of an exemplary rail support.

FIG. 10 shows the dynamic stiffness of the sample vs time for a mean stress of 20.020 kN. It can be seen that the dynamic stiffness ranges about 5600 N/m. The oscillation rate was ±10.0 with frequencies of 5.0, 10.0, 15.0 and 20.0 Hz.

Figure 11:
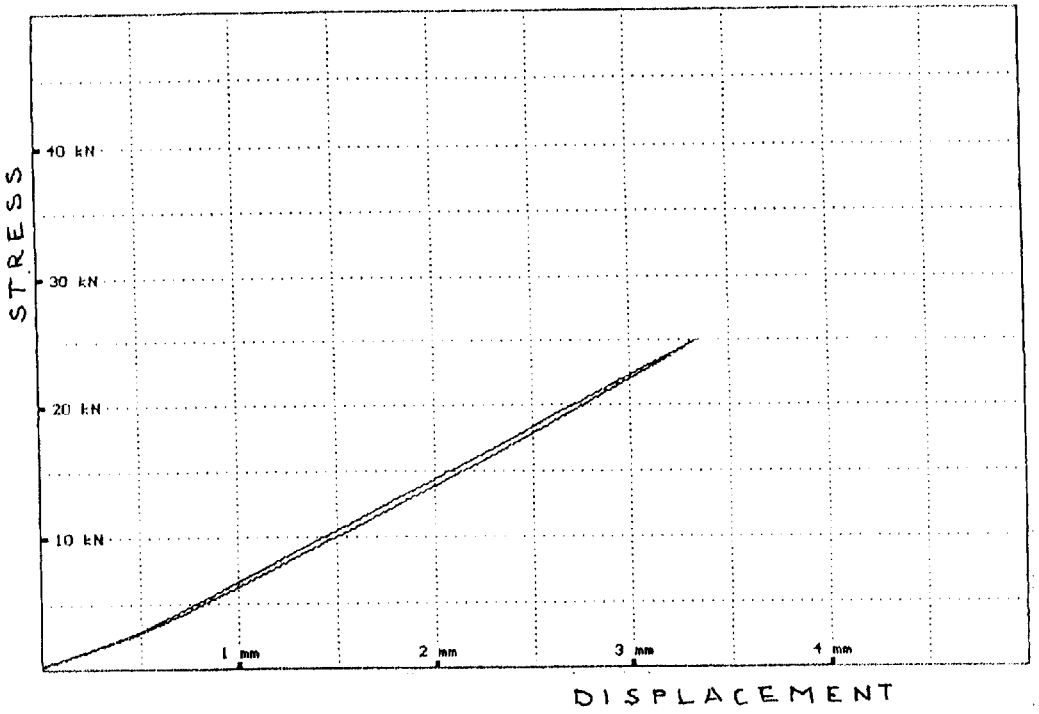
FIG. 11 represents the loading curve of the prestressing springs used in a device according to the invention.

FIG. 11 shows the compression stress vs displacement of the jack. The maximum measured compression stress was about 25 kN. The prestress was fixed at the level of 15 kN.

Figure 12:
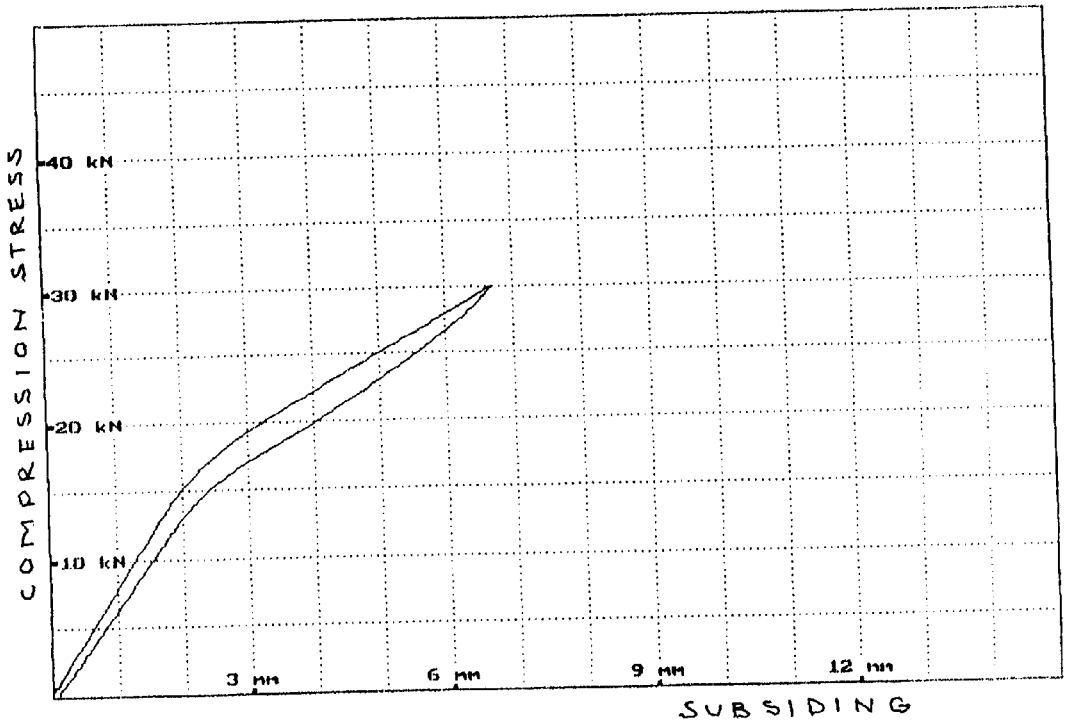
FIG. 12 shows the static loading curve of a device according to the invention.
Figure 13:
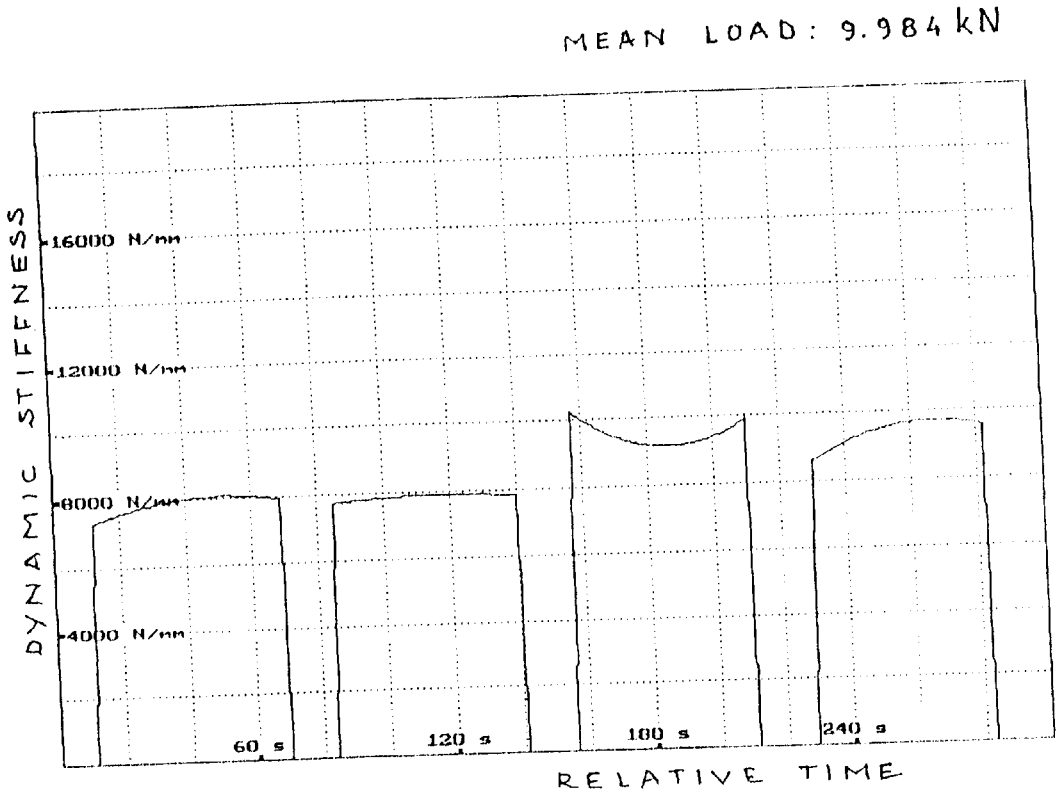
FIG. 13 through FIG. 16 illustrate the dynamic stiffness of a sample of rail supported by devices according to the invention, for four different load levels.
Figure 14:
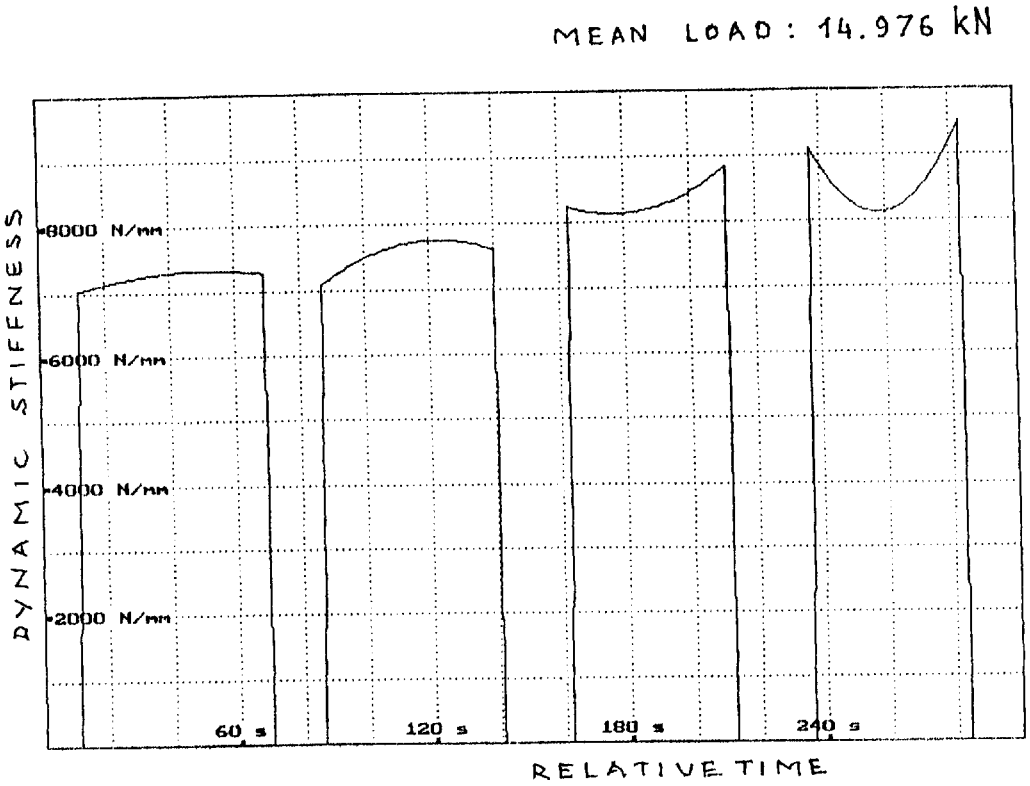
Figure 15:
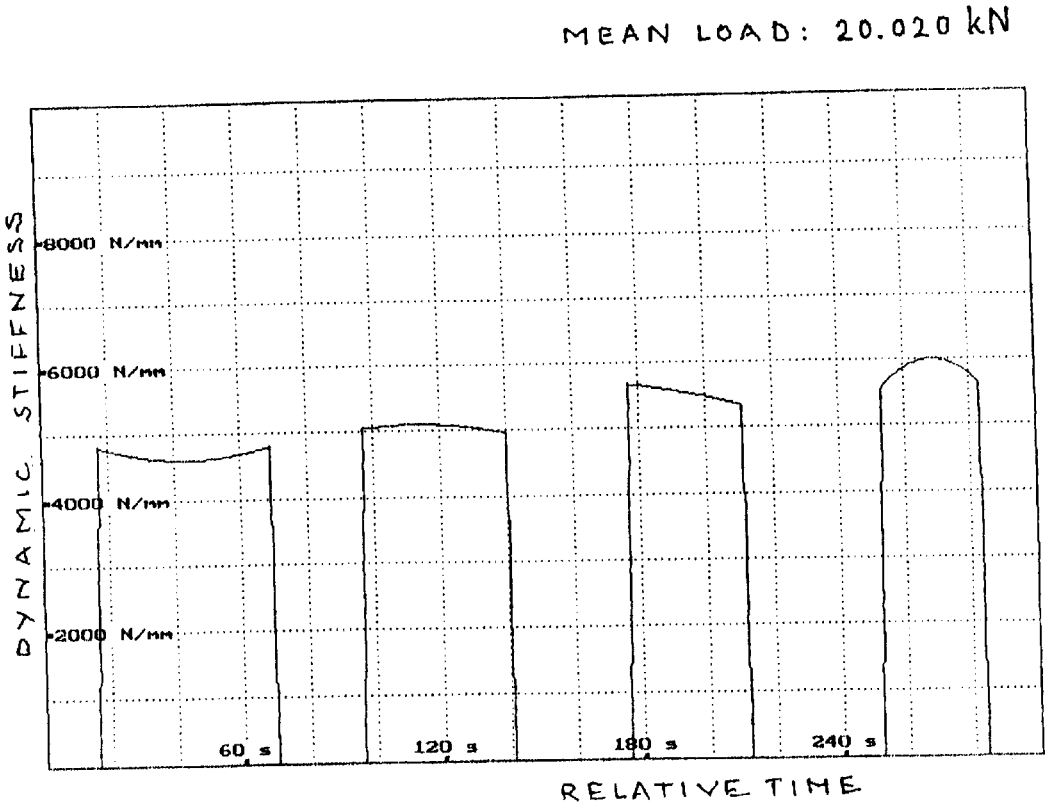
Figure 16:
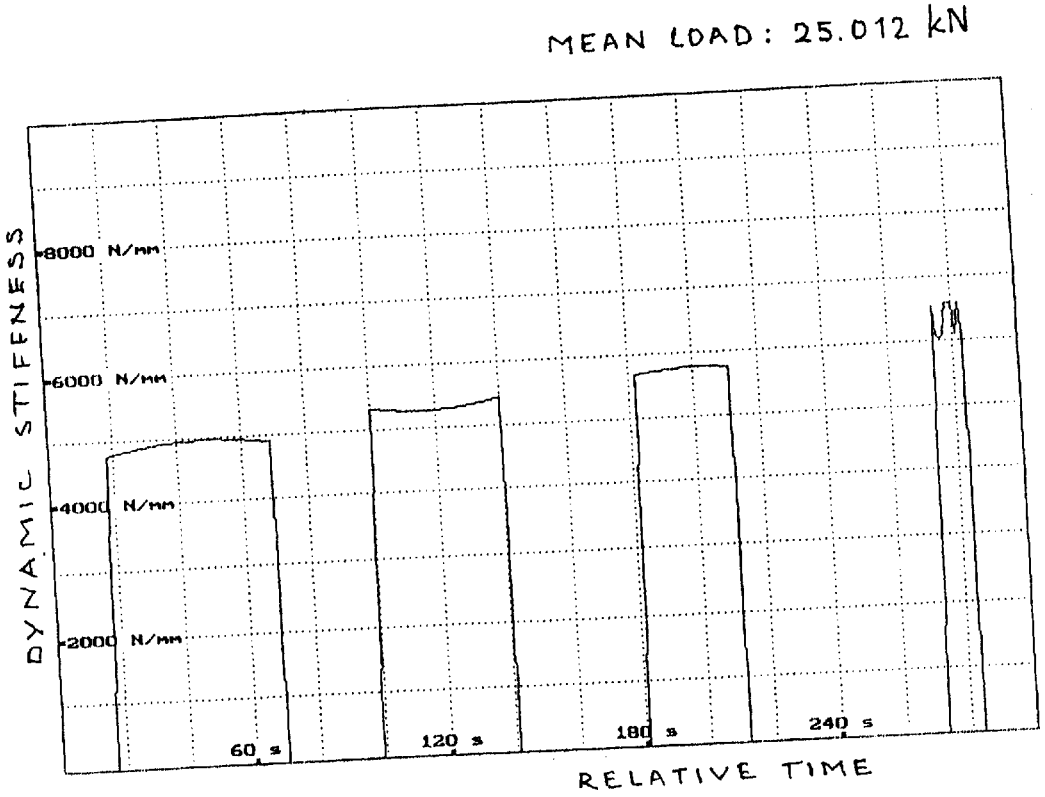

FIGS. 12 through 16 illustrate the test results after the system was mounted. The curve shown in FIG. 12 illustrates the static loading of the system with a load applied at a rate of 30.0 kN/min up to a maximum load of 29.952 kN. The measurements were as follows:

| Tangent modul | |
|---|---|
| at 3.0 kN: | 7460 N/mm |
| at 6.0 kN: | 7702 N/mm |
| Tangent modul | |
| at 9.0 kN: | 7726 N/mm |
| at 12.0 kN: | 7267 N/mm |
| at 15.0 kN: | 5730 N/mm |
| at 18.0 kN: | 3754 N/mm |
| at 21.0 kN: | 2916 N/mm |
| at 24.0 kN: | 2855 N/mm |
| at 27.0 kN: | 2964 N/mm |
| Hysteresis loop area (N.mm): | 11904 |

The measurements show that the static stiffness of the assembly ranges about 7600 N/mm for a load lower than 15.0 kN and about 3600 N/mm for a load higher than 15.0 kN. The residual deflection at 25 kN is about 5 mm for a slow load. This deflection compares with the deflection of about 3 mm for a fast loading up to 25 kN as illustrated in FIG. 7. The static deflection is always higher for slow loading than in the case of fast loading.

FIGS. 13, 14, 15 and 16 illustrate the dynamic behaviour of the sample for load levels at about 10, 15, 20 and 25 kN, respectively. These diagrams show that the dynamic stiffness is about:

8600 N/mm for a load lower than 15.0 kN

5600 N/mm for a load higher than 15.0 kN.

These results prove the excellent dynamic behaviour of the fixing device of the invention and they show that when using the invention, the rail deflection is limited to ±3 mm.

What is claimed is:

1. A device for supporting a rail, said device comprising:

an anti-vibration pad to be placed on a support structure, a sole plate resting on said anti-vibration pad for supporting the rail, at least one adjustable prestressing resilient device acting on the sole-plate to urge said sole-plate towards said support structure and to apply a defined prestressing force to said anti-vibration pad, each prestressing resilient device including a threaded bolt, an adjusting nut and a vertically acting spring assembly, said vertically acting spring assembly including a first spring having a first stiffness, a second spring arranged around the first spring and having a second stiffness higher than said first stiffness, and means for retaining said first and second springs in such a way that each of said springs is able to act independently from the other one.

2. A device according to claim 1, wherein said retaining means comprise a supporting washer arranged to support a first end of said first and second springs, and an abutment washer arranged to cooperate with the second end of said first and second springs, said abutment washer cooperating with said adjusting nut.

3. A device according to claim 1, wherein said retaining means comprise a supporting washer arranged to support a first end of said first spring, a sleeve enclosing the first spring, said sleeve being arranged to cooperate with the second end of said first spring and being further arranged to cooperate with a first end of the second spring, and an abutment washer arranged to cooperate with the second end of said second spring, said abutment washer cooperating with said adjusting nut.

4. A device according to claim 1, wherein the sole plate is comprised of a body having a platform to rest on top of the anti-vibration pad, said platform connecting with projections which extend perpendicularly to the platform so as to cover the sides of the anti-vibration pad, each of sad projections connecting in turn with a rim portion extending at a lower level than the platform, said rim portion having a hole therethrough for mounting the sole plate.

5. A device according to claim 1, further comprising a base-plate lying under the anti-vibration pad, with a leveiling insert therebetween, said base-plate being provided for being fastened to said support, and wherein said threaded bolt has a head received in a recess in the base-plate in such a way that the sole-plate and the base-plate are urged towards one another, with the anti-vibration pad therebetween.

6. A device according to claim 5, wherein the base-plate is fastened onto the support structure with said insert having a thickness adapted to leveling the rail.

7. A device according to claim 6, wherein the base-plate presents upstanding projections and the device comprises adjustment means cooperating with said upstanding projections for adjusting the position of the sole-plate with respect to the base-plate.

8. A sole plate in combination with a device including an anti-vibration pad to be placed on a support structure, at least one adjustable prestressing resilient device applying a defined prestressing force to said anti-vibration pad, the prestressing resilient device including a threaded bolt, an adjusting nut, and a vertically acting spring assembly that includes a first spring having a first stiffness and a second spring arranged around the first spring, said second spring having a second stiffness higher than said first stiffness, and means for retaining said first and second springs in such a way that each of said springs is able to act independently from the other one, said sole plate comprising:

a body having a platform resting on top of said anti-vibration pad, projections extending perpendicularly from the platform for covering the sides of the anti-vibration pad, and a rim portion extending from said projections, said rim being located at a level lower than the platform for mounting the sole plate.

* * * * *